United States Patent [19]

Fushimi et al.

[11] 4,340,980

[45] Jul. 27, 1982

[54] WATER CLOSET WITH TOPICAL BODY WASHER

[75] Inventors: Takehiko Fushimi; Shinji Kawai; Kazutaka Kuwana, all of Aichi, Japan

[73] Assignee: Aisin Seiki Kabushiki Kaisha, Aichi, Japan

[21] Appl. No.: 227,498

[22] Filed: Jan. 22, 1981

[30] Foreign Application Priority Data

Feb. 19, 1980 [JP] Japan ..... 55-19889[U]

[51] Int. Cl.[3] ..... A47K 4/00; A47K 4/03

[52] U.S. Cl. ..... 4/448; 4/443; 4/420.2; 4/420.4

[58] Field of Search ..... 4/448, 447, 443, 420.2, 4/420.4, 420.3, 420.5

[56] References Cited

U.S. PATENT DOCUMENTS

| | | | |
|---|---|---|---|
| 2,094,170 | 9/1937 | Heald | 4/420.2 |
| 3,195,148 | 7/1965 | Merkel, Jr. | 4/447 |
| 3,247,524 | 4/1966 | Umann | 4/447 |
| 3,570,015 | 3/1971 | Rosengaus | 4/420.4 |
| 3,605,124 | 9/1971 | Marcard et al. | 4/420.2 |
| 3,914,804 | 10/1975 | Schrader et al. | 4/420.4 X |
| 3,995,326 | 12/1976 | Umann | 4/447 X |
| 4,068,325 | 1/1978 | Banthin | 4/420.4 |
| 4,087,868 | 5/1978 | Gentz | 4/447 |
| 4,181,985 | 1/1980 | Rius | 4/420.4 X |
| 4,304,016 | 12/1981 | Oguma et al. | 4/448 |

*Primary Examiner*—Henry K. Artis

*Attorney, Agent, or Firm*—Oblon, Fisher, Spivak, McClelland & Maier

[57] ABSTRACT

A water closet with a topical body washing mechanism including a water warmer mounted on the water closet and a spout pipe having a nozzle at the distal end therof for spouting warm water from the water warmer. The spout pipe is movable to and from an inoperative rest position within a bowl of the water closet, a second position advanced over the bowl to direct a jet of warm water toward the anus of the user and a third position further advanced over the bowl to direct a jet of warm water in a direction suitable for use as a bidet. An operating lever has a cam mounted on its rotational axis, the cam being contoured correspondingly to the second and third positions of the spout pipe to actuate a switch thereby starting a motor of a pump which sends forward warm water from the water warmer to the spouting nozzle. The electric circuit which includes the aforementioned motor and switch has in series a switching element and a delay circuit. When the motor switch is closed by the cam, the switching element is actuated starting the emission of water jets with a delay. Therefore, gushing of water at the second position is prevented when the spout pipe is shifted quickly from the first to the third position.

5 Claims, 4 Drawing Figures

WATER CLOSET WITH TOPICAL BODY WASHER

BACKGROUND OF THE INVENTION

1. Field of the Invention

This invention relates to an improvement in a bidet or a device for washing part of the human body, and more particularly to a device for controlling the function of jetting washing water.

2. Description of the Prior Art

In this connection, Applicant's copending Japanese Patent Application, filed on Nov. 21, 1978 and laid open to public inspection on May 31, 1980 as Unexamined Patent Application No. 72530/1980 in the Official Gazette issued by the Japanese Patent Office, discloses a single-lever type dual position bidet to be mounted on a water closet, which is capable of starting and stopping a spurt of washing water by manipulation of a single lever which is rotatable stepwise into two operating positions to select a nozzle position between a first position for anal washing and a second position for serving the purpose of a bidet.

In the above-mentioned copending application, a water jet comes out in both of the two operating position so that, when the operating lever is turned past the first position with the intention of bathing the water jet in the second position, a water jet comes off at the first position, halfway to the intended second position, resulting in an uncomfortable feeling to some users.

SUMMARY OF THE INVENTION

With the foregoing in view, the present invention contemplates preventing the uncomfortable emission of water jets at an unintended position.

According to the present invention, there is provided a water closet with a topical body washing mechanism including a water closet, a container of washing water mounted on the water closet, a spout pipe rotatably supported in the container and rotatable to fixably shift a water spouting nozzle at the inner end thereof to first, second and third positions along the longitudinal center line of a bowl of the water closet; and a control circuit including a switch operated in relation with rotation of an operating lever of the spout pipe and adapted to be closed at the second and third positions of the spout pipe to actuate a motor of a pump which pushes forward the washing water from the container to the spout pipe, a switching element connected in series to the pump motor, and a delay circuit for rendering the switching element conductive upon a lapse of a predetermined time period after actuation of the motor switch.

It is an object of the present invention to provide a delay control on the initiation of water jetting when the operating lever is turned into service positions.

It is another object of the present invention to prevent the emission of water jets at the second service position of the spout pipe when the operating lever is turned quickly to the second operating position (the third service position of the spout pipe) past the first operating position (the second service position of the spout pipe).

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1:
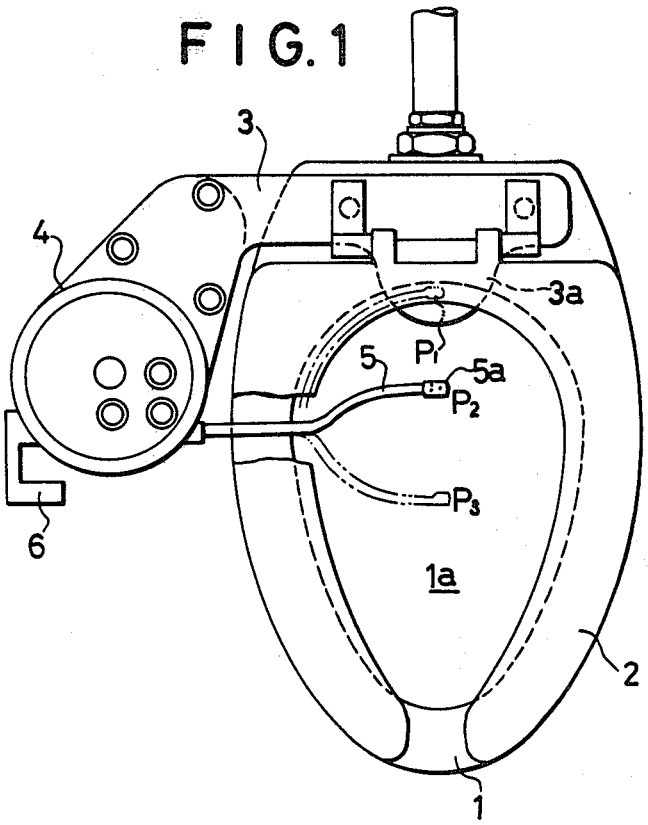
FIG. 1 is a plan view showing a water closet incorporating the present invention.

Referring to the accompanying drawings, a water warmer 4 is supported on one side of a water closet 1 through a bracket 3 which is secured to the water closet 1. Water warmer 4 is supplied with water from a water tank and by operation of a pump (not shown) and provided with a heater (also not shown) to warm up water which is to be jetted through a nozzle 5*a* at the distal end of a spout or jet pipe 5. Spout pipe 5 which is passed horizontally through the water warmer 4 has its base portion rotatably supported therein and is provided with an operating lever 6 integrally at its outer end away from the water closet 1.

Spout pipe 5 is provided with the nozzle 5*a* securely at the outer end thereof and extended through a clearance between the water closet 1 and a seat 2 2, an inner portion of the spout pipe 5 which extends over the inner bowl 1*a* of the water closet 1 being curved such that it lies along the inner side of the rear upper edge of the bowl 1*a* when in a non-operating rest position, with a nozzle 5*a* located in a position $P_1$ on the longitudinal center line of the bowl 1*a* as shown in FIG. 1. Nozzle 5*a* in the rest position $P_1$ is concealed behind a shelter portion 3*a* of the bracket 3.

Figure 2:
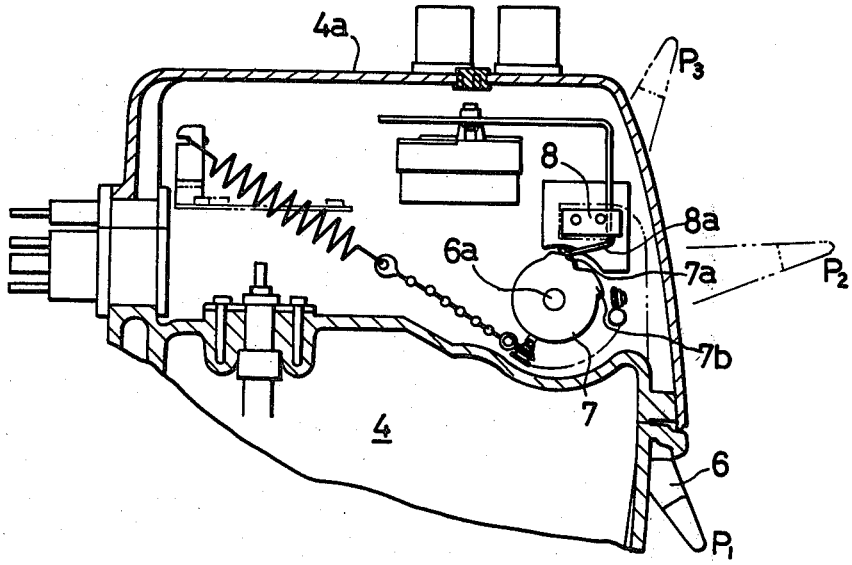
FIG. 2 is a fragmentary sectional view showing on an enlarged scale essential components of the invention.

Spout pipe 5 which has its base portion journalled in the water warmer 4 in communication with the water reservoir of the latter through a suitable conduit assembly (not shown) is rotatable into positions $P_2$ and $P_3$ of FIG. 1 by rotating the operating lever 6. In this instance, the nozzle 5*a* is moved along the bottom of the bowl 1*a* and the spout pipe 5 is resiliently held either in the position $P_1$ or $P_2$ by a suitable click-motion positioning mechanism (not shown). A spout hole in the nozzle 5*a* is located such that slightly forwardly and rearwardly declined water jets are spouted from the bottom of the bowl 1*a* in the positions $P_1$ and $P_2$, respectively. Namely, the nozzle 5*a* in the position $P_1$ directs the water jets toward the anus of a person who sits on the seat 2 and in the position $P_2$ directs the water jets in a direction suitable for use as a bidet. As shown in FIG. 2, a cam 7 is mounted on a shaft 6*a* of the operating lever 6 and which is provided with two rised portions 7*a* and 7*b* to thereby press an actuator 8*a* on a switch 8, which is suitably mounted on an upper casing 4*a* of the water warmer 4, sucessively upon rotation of the lever 6. As soon as the switch 8 is closed, a pump (not shown) is actuated to push forward water in the water warmer 4 toward the spout pipe 5. The foregoing construction of the topical bathing device is disclosed in Applicant's copending application No. 144541/78.

As mentioned hereinbefore, in a case where the water jets are controlled directly by switch 8, when the nozzle 5*a* is rotated from the rest position $P_1$ to the position $P_3$ to use it as a bidet, a water jet comes out at the anal position $P_2$ in the middle of the rotation operation to the bidet position $P_3$.

Figure 3:
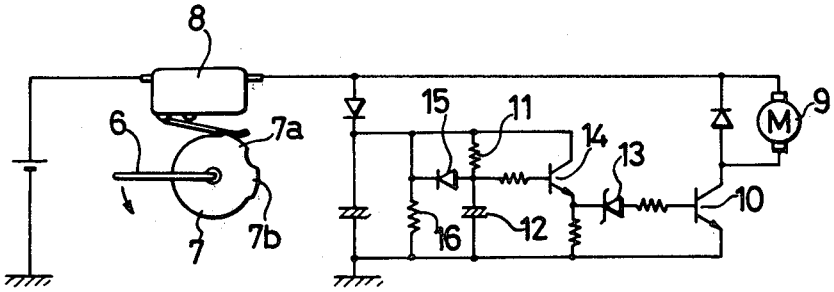
FIG. 3 is a diagram of an electrical circuit for controlling the water jetting function according to the invention.

According to the present invention, a delay circuit is provided between the switch 8 and the drive motor 9 for the water pump (not shown). More particularly, as shown in FIG. 3, a switch element 10 is connected in series with the drive motor 9 and has its trigger control input terminal connected to a charge circuit including a Zener diode 13 which determines the threshold trigger value according to the increase in charged voltage, a resistor 11 and a capacitor 12 which determine the time constant of the charge circuit, and a transistor 14 connected therebetween. A diode 1 and a resistor 16 are inserted to serve as a discharge mechanism when the switch 8 is turned off. The delay action of this delay circuit is determined by the charging speed of the capacitor 12 and the operating voltage of the Zener diode 13. For example, a practical delay action of about 1 second is obtained in a case using a power source of 24 V and a trigger voltage for the switching element 10 at about 8 V.

By incorporating in this manner a delay-action mechanism in the switching mechanism which controls the drive motor 9 of the jet pump in relation with the rotation of the nozzle 5*a* by the manipulation of the operating lever 6, even if the switch 8 is once turned on at the anal position $P_2$ during the continued turn of the operating lever 6, the charged voltage in the capacitor 12 is discharged on the side of the resistor 16 as the switch 8 is transistorily turned off before conduction of the switching element 10. Upon reaching the position $P_3$, the capacitor 12 again starts charging for a predetermined time period, during which the pump drive motor 9 is held in an off-state.

Figure 4:
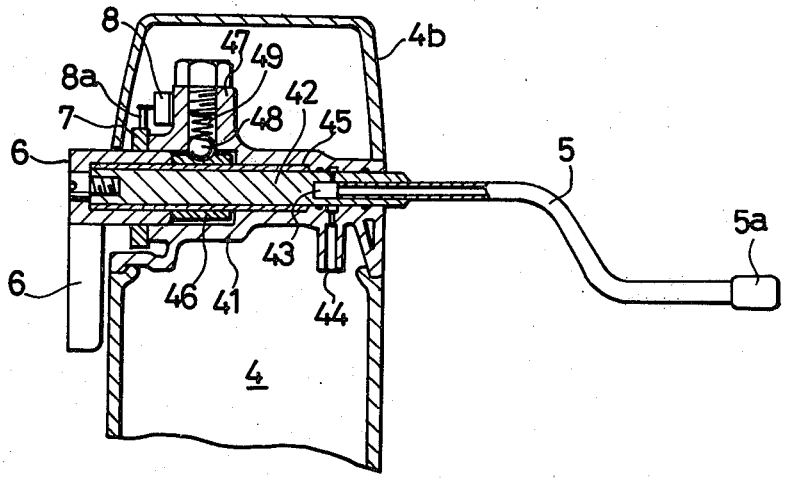
FIG. 4 is a fragmentary vertical section of the embodiment of FIG. 1.

Referring to FIG. 4, the spout pipe 5 has its base portion water-tightly fitted in a bore 43 at the inner end of a shaft body 42 which is supported rotably about a horizontal axis, within a metal collar 41 which is provided integrally with the water warmer 4. The bore 43 communicates with a pipe 44, which is projectingly provided on the metal collar 41, to send warm water to the spout 5. The circumference of the shaft 42 is covered with a pipe 45 of a synthetic resin material which serves as a bearing and simultaneously as a water-tight seal. Fixed on the synthetic resin pipe 45 is a metal ring 56 which is circumferentially provided with three recesses at positions corresponding to the positions $P_1$, $P_2$ and $P_3$ of the nozzle 5A for engagement with a ball 48 which is received in a cylindrical sleeve 47 on the metal collar 41 and urged toward the latter by a spring 49.

The switch is fixedly mounted on the cylindrical sleeve 7, with its actuator 8*a* in engagement with a cam 7 which is fixed on a shaft 6*a* of the operating lever 6 attached to the other end of the shaft body 42.

With the foregoing arrangement, upon rotating the operating lever 6, the ball 48 is successively brought into engagement with the recesses on the ring 46 at the nozzle positions $P_1$, $P_2$ and $P_3$ of the spout pipe 5, releasably retaining the spout pipe 5 in the respective positions by a clicking motion in cooperation with the resilient force of the spring 49.

As is clear from the foregoing description, in the present invention the inadvertent emission of water at an undesired jet angle or before an intended nozzle position is reached is prevented without impairing the convenience of operation of controlling the stop and start of the warm water jets simultaneously with the stepwise shifts of the water spout nozzle to and from anal and bidet positions by manipulation of a single operating lever, thus ensuring more comfortable use of the topical bathing apparatus as compared with the conventional counterparts.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A water closet having a bowl, a pump and a topical body washing means, comprising:

a container for holding washing water;

a spout pipe having a jet nozzle at the distal end thereof, rotatably supported in said container and extending perpendicularly to the longitudinal center line of said bowl of said water closet.

means for movably shifting said jet pipe and for shifting said jet nozzle at the distal end thereof fixably to at least three positions along said longitudinal center line of said bowl;

a rotatable operating lever for shifting the position of said spout pipe between a first, second and third position;

a switch operated in relation with the rotation of said operating lever to close at said second and third position of said spout pipe;

a motor for driving said pump for pushing forward washing water in said container toward said spout pipe; and a motor drive control circuit comprising a switching element connected in series to said motor and said switch and a delay circuit for actuating said switching element upon lapse of a predetermined time period after actuation of said switch.

2. A water closet as set forth in claim 1, said spout pipe including a rotatable shaft portion and further comprising a click-motion positioning means disposed between said rotational shaft portion of said spout pipe and said container for resiliently holding said spout pipe in said second and third positions.

3. A water closet as set forth in claim 1, said delay circuit further comprising a charging circuit adapted to start charging upon actuation of said switch wherein said switching element is triggered into a conducted state at a predetermined threshold value according to the increase of the charged voltage in said charge circuit.

4. A water closet as set forth in claim 3, said delay circuit further comprising a discharge circuit for discharging charged voltage as soon as said switch is turned off.

5. A water closet as set forth in claim 3, said switching element further comprising a trigger input terminal and said delay circuit further comprising a Zener diode, a resistor and a capacitor, said Zener diode being connected to a trigger control input terminal of said switching element for determining the triggering threshold value of the increasing voltage of said charge circuit, the time constant of which is determined mainly by said resistor and said capacitor, setting the time period of delay action by the charging speed of said capacitor and the operating voltage of said Zener diode.

* * * * *